US008850853B2

(12) United States Patent
Lonati et al.

(10) Patent No.: US 8,850,853 B2
(45) Date of Patent: Oct. 7, 2014

(54) KNITTING MACHINE, PARTICULARLY WITH A HIGH GAUGE

(75) Inventors: Ettore Lonati, Botticino (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 13/881,009

(22) PCT Filed: Jul. 27, 2011

(86) PCT No.: PCT/EP2011/062895

§ 371 (c)(1), (2), (4) Date: Apr. 23, 2013

(87) PCT Pub. No.: WO2012/055591

PCT Pub. Date: May 3, 2012

(65) Prior Publication Data

US 2013/0213093 A1 Aug. 22, 2013

(30) Foreign Application Priority Data

Oct. 26, 2010 (IT) ..... MI2010A1974

(51) Int. Cl.

| | |
|---|---|
| ***D04B 15/14*** | (2006.01) |
| ***D04B 15/10*** | (2006.01) |
| ***D04B 15/18*** | (2006.01) |
| ***D04B 15/16*** | (2006.01) |

(52) U.S. Cl.

CPC ..... *D04B 15/10* (2013.01); *D04B 15/18* (2013.01); *D04B 15/16* (2013.01); *D04B 15/14* (2013.01)

USPC ..... 66/115; 66/114

(58) Field of Classification Search

CPC ..... D04B 15/10; D04B 15/14; D04B 15/18

USPC ..... 66/114, 115, 31

See application file for complete search history.

(56) References Cited

U.S. PATENT DOCUMENTS 2,399,440 A * 4/1946 Koppel ..... 66/115
3,301,014 A * 1/1967 Wiesinger ..... 66/115

(Continued)

FOREIGN PATENT DOCUMENTS

DE 610511 C 3/1935
WO W02008003463 A1 1/2008

(Continued)

OTHER PUBLICATIONS

International Search Report and Written Opinion dated Nov. 3, 2011 issued in PCT/EP2011/062895.

*Primary Examiner* — Danny Worrell

(74) *Attorney, Agent, or Firm* — Scully, Scott, Murphy & Presser, P.C.

(57) ABSTRACT

A knitting machine comprising a needle holder, which supports a plurality of needles which can be actuated with an alternating motion along their axis and means for guiding the needles on the needle holder which comprise channels for forming knitting which are defined proximate to the end of the needle holder and sliding channels which are defined on the needle holder in a region that is spaced from the end of the needle holder, each one of the channels for forming knitting being engageable by a needle and defining with its inlet, which is directed toward the outside of the needle holder, resting contact regions for the knitting during the retracting motion of the needles, the number of the sliding channels being smaller than the number of the channels for forming knitting.

15 Claims, 10 Drawing Sheets

(56) References Cited

U.S. PATENT DOCUMENTS

| | | | | | |
|---|---|---|---|---|---|
| 3,545,233 | A * | 12/1970 | Lombardi | 66/8 |
| 5,398,526 | A * | 3/1995 | Liu | 66/8 |
| 5,577,401 | A * | 11/1996 | Pernick | 66/8 |
| 5,609,044 | A * | 3/1997 | Tacy | 66/115 |
| 7,469,561 | B2 * | 12/2008 | Krauss | 66/115 |
| 8,484,998 | B1 * | 7/2013 | Pai | 66/8 |
| 2008/0184745 | A1 | 8/2008 | Krauss | |

FOREIGN PATENT DOCUMENTS

| | | | |
|---|---|---|---|
| WO | WO 2008145433 | A1 | 12/2008 |
| WO | W02010066219 | A1 | 6/2010 |

* cited by examiner

KNITTING MACHINE, PARTICULARLY WITH A HIGH GAUGE

TECHNICAL FIELD

The present invention relates to a knitting machine particularly with high gauge.

BACKGROUND ART

As is known, knitting machines comprise a needle holder that supports a plurality of needles, which are arranged mutually side by side and can be actuated with an alternating motion along their axis with respect to the needle holder in order to form knitting. In this alternating motion, the needles are conveniently guided by the needle holder and/or by other elements connected to the needle holder.

More particularly, each needle can be actuated with an alternating motion along its own axis with an extraction motion, by means of which the needle is extracted with its tip or head and with a portion of its shank from one end of the needle holder in order to drop, onto its shank, the loop of knitting formed previously and/or in order to pick up the yarn or yarns dispensed at a drop or feed of the machine, and with a retraction motion, by means of which the needle is made to retract with its tip into the end of the needle holder in order to form a new loop of knitting, performing knockover of the loop of knitting formed previously.

In their alternating motion with respect to the needle holder, the needles are guided, being arranged within sliding channels defined within the needle holder and optionally in other elements connected to the needle holder.

For example, in single-cylinder circular knitting machines, in which the needle holder is constituted by a cylinder, known indeed as needle cylinder, which has a vertical axis, the needles are arranged slidingly within axial sliding channels defined on the lateral surface of the needle cylinder. These sliding channels are separated from each other by elements known as slats. In some cases, the sliding channels are constituted by axial grooves which are defined in the lateral surface of the body of the needle cylinder. In these cases, the slats are constituted by the portions of the needle cylinder that are located between the various axial grooves. In other cases, the sliding channels are obtained by inserting laminas, which constitute the above cited slats, within axial cuts defined in the lateral surface of the needle cylinder.

Single-cylinder circular knitting machines are generally provided, at the upper end of the needle cylinder, with an annular element, which is fixed integrally around the upper end of the needle cylinder and is provided with radial cuts, inside each of which a sinker is arranged, and these radial cuts are angularly offset around the needle cylinder axis with respect to the needle sliding channels so that each sinker is located between two contiguous needles.

The sinkers can move radially with respect to the needle cylinder so as to cooperate with the needles in forming the knitting. These sinkers have an upper side, known as knockover plane, on which the portion of knitting located between two contiguous needles rests when said needles, after picking up the yarn or yarns at a feed or drop of the machine, retract with their tip into the end of the needle cylinder in order to form a new loop of knitting. In these machines, proximate to the end of the needle cylinder from which they exit in order to pick up the yarn or yarns, the needles are guided within knitting forming channels, each delimited laterally by two contiguous sinkers. These knitting forming channels in practice constitute extensions of the sliding channels cited above.

Circular knitting machines with cylinder and dial are composed of a needle cylinder, which is substantially provided like the needle cylinder of single-cylinder machines and with a dial which is arranged above and coaxially with respect to the needle cylinder. In the upper face of the dial a plurality of sliding channels is provided, which are oriented radially with respect to the axis of the dial and are angularly offset with respect to the sliding channels defined in the needle cylinder. A needle is arranged in each one of these sliding channels of the dial and can be actuated with an alternating motion along the corresponding sliding channel so as to exit with its tip from the peripheral edge of the dial in order to pick up the yarn or yarns provided at a drop or feed of the machine and so as to retract in order to form a new loop of knitting, in a manner which is similar to what has been described with reference to the needles of the needle cylinder. These machines have no sinkers and the needles arranged in the dial cooperate with the needles arranged in the needle cylinder in forming the knitting. In particular, the needles of the dial can be used to retain the knitting, formed previously, during the extraction motion of the needles located in the needle cylinder, preventing it from being drawn upwardly, causing knitting errors. Likewise, the needles of the needle cylinder can be used to retain the knitting, formed previously, during the motion of extraction of the needles arranged in the dial.

Some types of single-cylinder circular machine, particularly with a high gauge, have no sinkers and the function of retaining the knitting during the needle extraction motion is performed by retention elements which are arranged laterally to the needles inside the needle cylinder and protrude, with one of their ends, above the upper end of the needle cylinder. These retention elements are shaped like laminas and are laterally adjacent to the needles, providing a sort of comb that can engage the loops of knitting formed previously, preventing them from being drawn upwardly by the rising motion of the needles during their extraction motion. Retention elements of this type are disclosed for example in WO2008/003463 and WO2008/145433 by the same Applicant.

In machines without sinkers, the knitting forming channels are constituted by an end portion of the needle sliding channels. In some machines, the knitting forming channels are delimited laterally by laminar elements, known as secondary sinkers, which are driven into axial cuts defined in the lateral surface of the needle cylinder proximate to its upper end.

In any case, in conventional machines, both in single-cylinder circular machines and in circular machines with cylinder and dial or more generally with a double bed, in each needle holder, be it a cylinder or a dial, there are as many sliding channels as there are knitting forming channels, and each one accommodates a needle.

The actuation of the needles with an alternating motion along the corresponding sliding channel is obtained by providing, for each needle, at least one heel that protrudes from one side of the needle holder and can engage paths defined by cams that face said side of the needle holder. The shape of these paths, together with the fact that the needle holder is moved with respect to the cams along a direction that is transverse to the extension of the sliding channels, achieves the alternating motion of the needles along the corresponding sliding channel. The engagement of each needle with these cams leads to a lateral thrust of the needle, i.e., transversely to the extension of the sliding channel in which it is arranged. This lateral thrust is discharged onto a side of the sliding channel, i.e., onto the slat that delimits on one side said sliding channel and must have an adequate thickness in order to withstand said thrust.

In order to calculate the thickness of the slat, i.e., the thickness of the region of the needle holder that separates two contiguous sliding channels, in conventional machines it is possible to apply the following formula:

$$\text{Slat thickness}=(25.4/E)-(S+G)$$

where:
E=gauge (needles/inch)
S=needle thickness (mm)
G=needle play (mm)

Needle play is the play between the needle and the sliding channel in which the needle is accommodated in a direction which is transverse to the axis of said needle.

As can be seen from the above cited formula, the thickness of the slat decreases as the gauge increases and the possibility to increase the gauge has a limit which is linked to the mechanical rigidity of the slat, whose strength, for an equal material used, obviously decreases as its thickness decreases.

In recent years, the market of knitting machines has seen a significant growth in the demand for machines that have ever higher gauges due to greater demand for increasingly fine and light knitted fabrics.

This demand has conferred an increasing importance to the problem of being able to provide machines with ever higher gauges. However, this problem cannot be solved easily, due to the fact that the thickness of the needle cannot be reduced beyond a certain limit, since it must meet specific requirements dictated by textile parameters and is already low in current machines with high gauges and the play necessary for its operation also cannot be eliminated.

On the other hand, the thickness of the slat also cannot be reduced excessively, since the slat is assigned the task of contrasting the lateral thrust that derives from the engagement of the needle with the cams that cause its actuation with an alternating motion within the corresponding sliding channel.

DISCLOSURE OF THE INVENTION

The aim of the present invention is to provide a knitting machine that can have a gauge that cannot be achieved with conventional machines or can have a gauge that can be compared with that of currently commercially available machines but with a strength and a reliability that are distinctly higher as regards the elements of the machine intended to form knitting.

Within this aim, an object of the invention is to provide a knitting machine that can be manufactured with competitive costs.

Another object of the invention is to provide a knitting machine that has a lower energy consumption than conventional machines.

Another object of the invention is to provide a knitting machine which, during its operation, generates less heat and therefore requires fewer refinements and lower consumption in order to provide for its cooling.

This aim and these and other objects that will become better apparent hereinafter, are achieved by a knitting machine comprising a needle holder which supports a plurality of needles which can be actuated with an alternating motion along their axis and means for guiding said needles on said needle holder, each one of said needles being actuatable with an alternating motion along its axis with respect to said needle holder with an extraction motion, by means of which the needle is extracted with its tip and with a portion of its shank from one end of the needle holder in order to drop, onto its shank, the previously formed loop of knitting and/or to pick up the yarn or yarns dispensed at a feed or drop of the machine, and with a retracting motion, by means of which the needle is made to retract with its tip into said end of the needle holder in order to form a new loop of knitting, performing knockover of the loop of knitting formed previously in order to produce knitting, said guiding means comprising channels for forming knitting which are defined proximate to said end of the needle holder and sliding channels which are defined on said needle holder in a region that is spaced from said end of the needle holder, each one of said channels for forming knitting being engageable by a needle and defining with its inlet, which is directed toward the outside of said needle holder, resting contact regions for the knitting during the retracting motion of the needles, characterized in that the number of said sliding channels is smaller than the number of said channels for forming knitting.

BRIEF DESCRIPTION OF THE DRAWINGS

Further characteristics and advantages of the invention will become better apparent from the description of two preferred but not exclusive embodiments of the machine according to the invention, illustrated by way of non-limiting example in the accompanying drawings, wherein:

FIG. 1 is a perspective view of a portion of the machine, illustrating, for the sake of simplicity and greater clarity, only part of the sliding channels, of the knitting forming channels, of the needles and of the sinkers;

FIG. 2 is a sectional view of the portion of the machine of FIG. 1 taken along a vertical plane, i.e., a plane that passes through the axis of the needle cylinder;

FIG. 3 is an enlarged-scale sectional view of FIG. 2, taken along the line III-III;

FIG. 4 is an enlarged-scale sectional view of FIG. 2, taken along the line IV-IV;

FIG. 5 is an enlarged-scale sectional view of FIG. 2, taken along the line V-V;

FIG. 6 is a perspective view of a portion of the machine, illustrating, for the sake of simplicity and greater clarity, only part of the sliding channels, of the knitting forming channels, of the needles and of knitting retention elements;

FIG. 7 is a sectional view of the portion of machine shown in FIG. 6, taken along a vertical plane, i.e., along a plane that passes through the axis of the needle cylinder;

FIG. 8 is an enlarged-scale sectional view of FIG. 7, taken along the line VIII-VIII;

FIG. 9 is an enlarged-scale sectional view of FIG. 7, taken along the line IX-IX;

FIG. 10 is an enlarged-scale sectional view of FIG. 7, taken along the line X-X.

WAYS OF CARRYING OUT THE INVENTION

Figure 1:
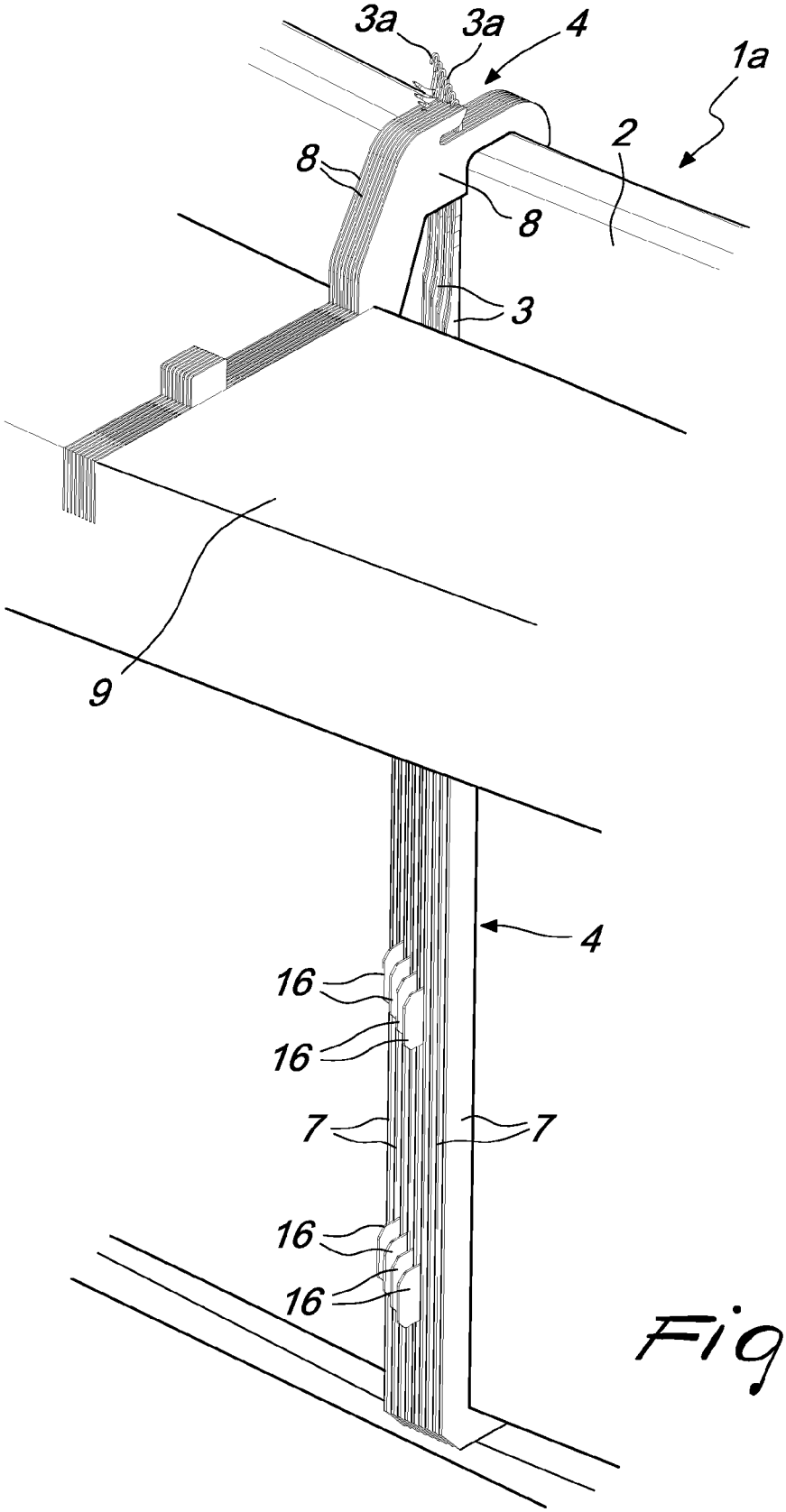
FIGS. 1 to 5 are views of a first embodiment of the machine according to the invention, constituted by a single-cylinder circular knitting machine provided with sinkers, more particularly.
Figure 2:
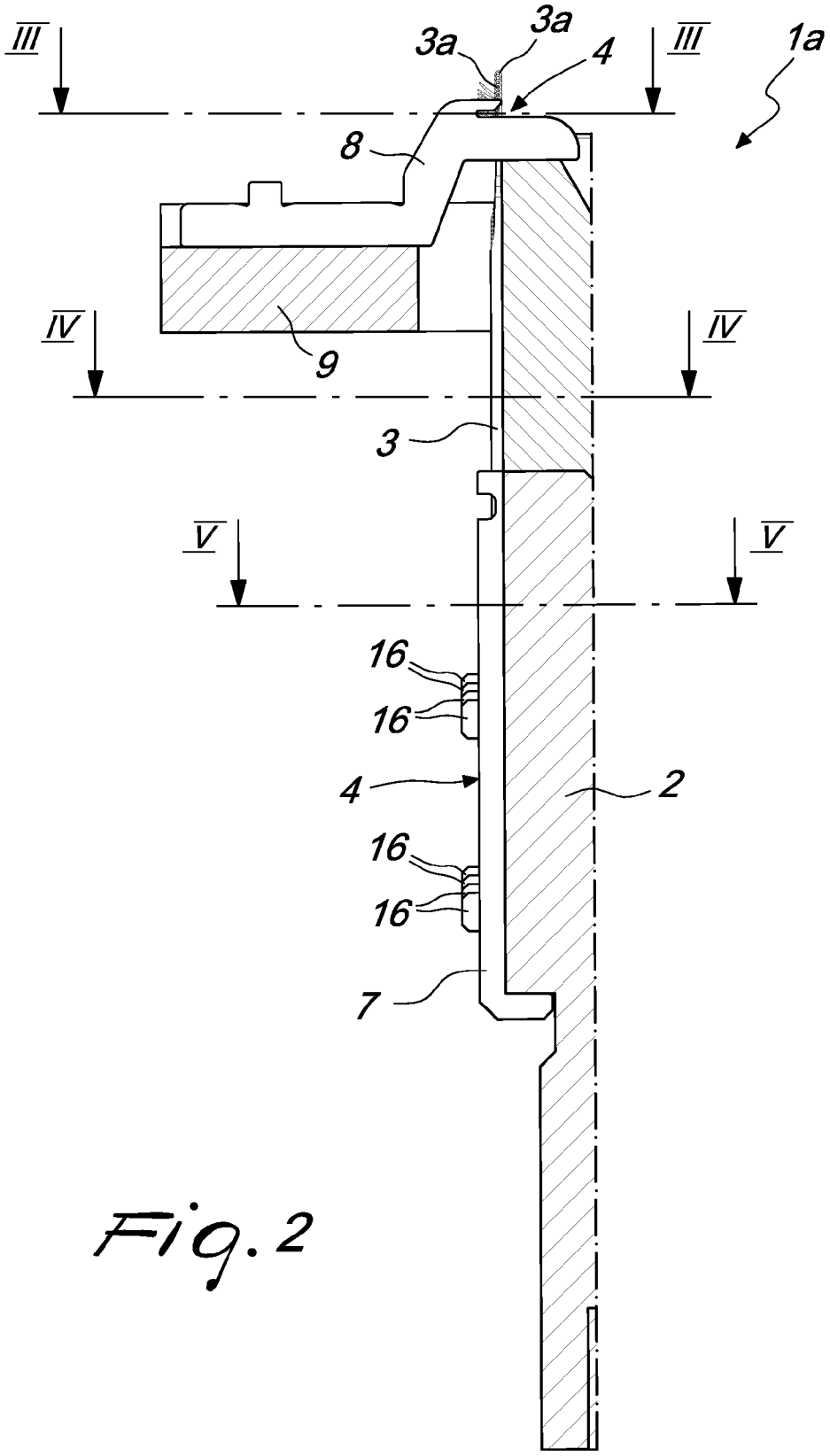
Figure 3:
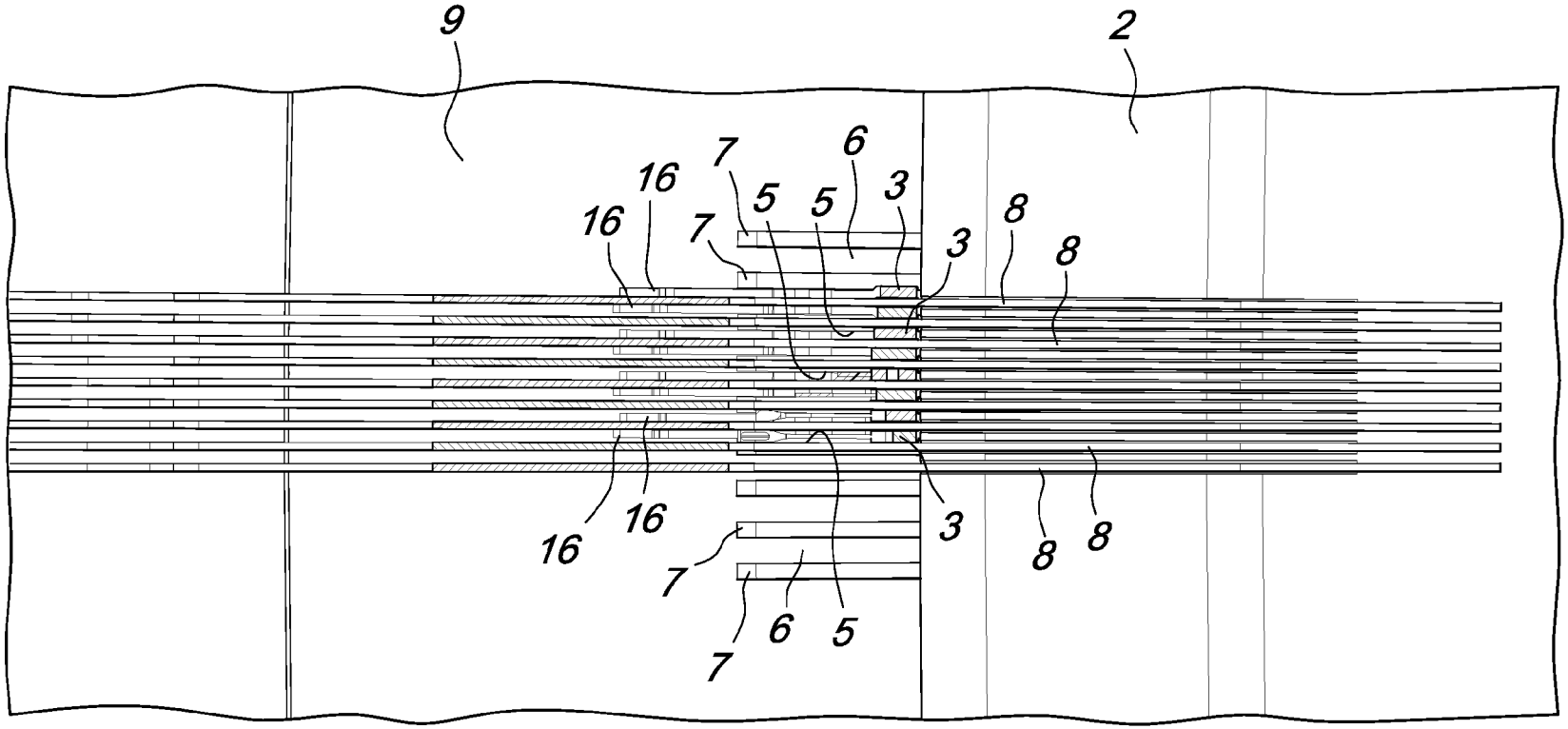
Figure 4:
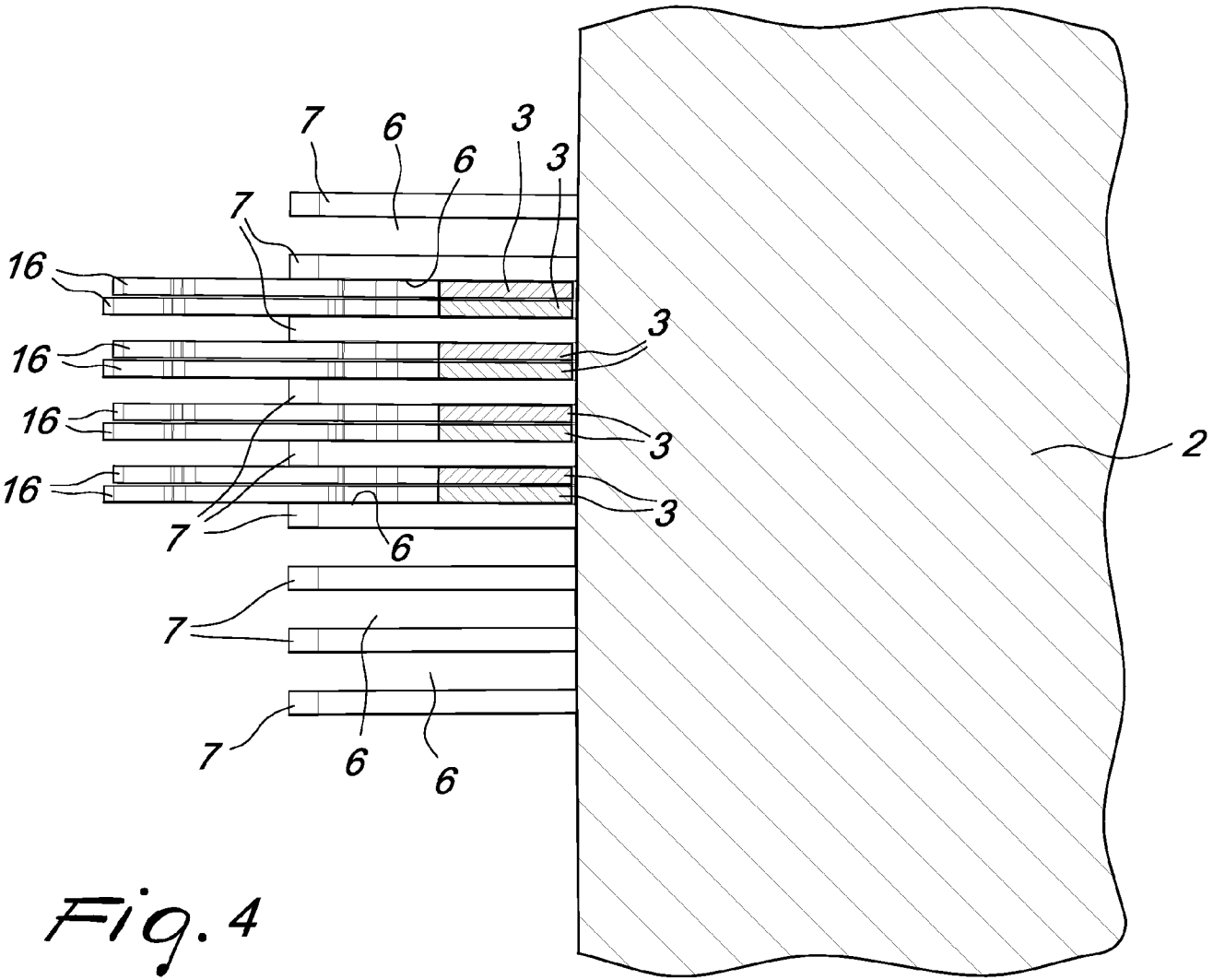
Figure 5:
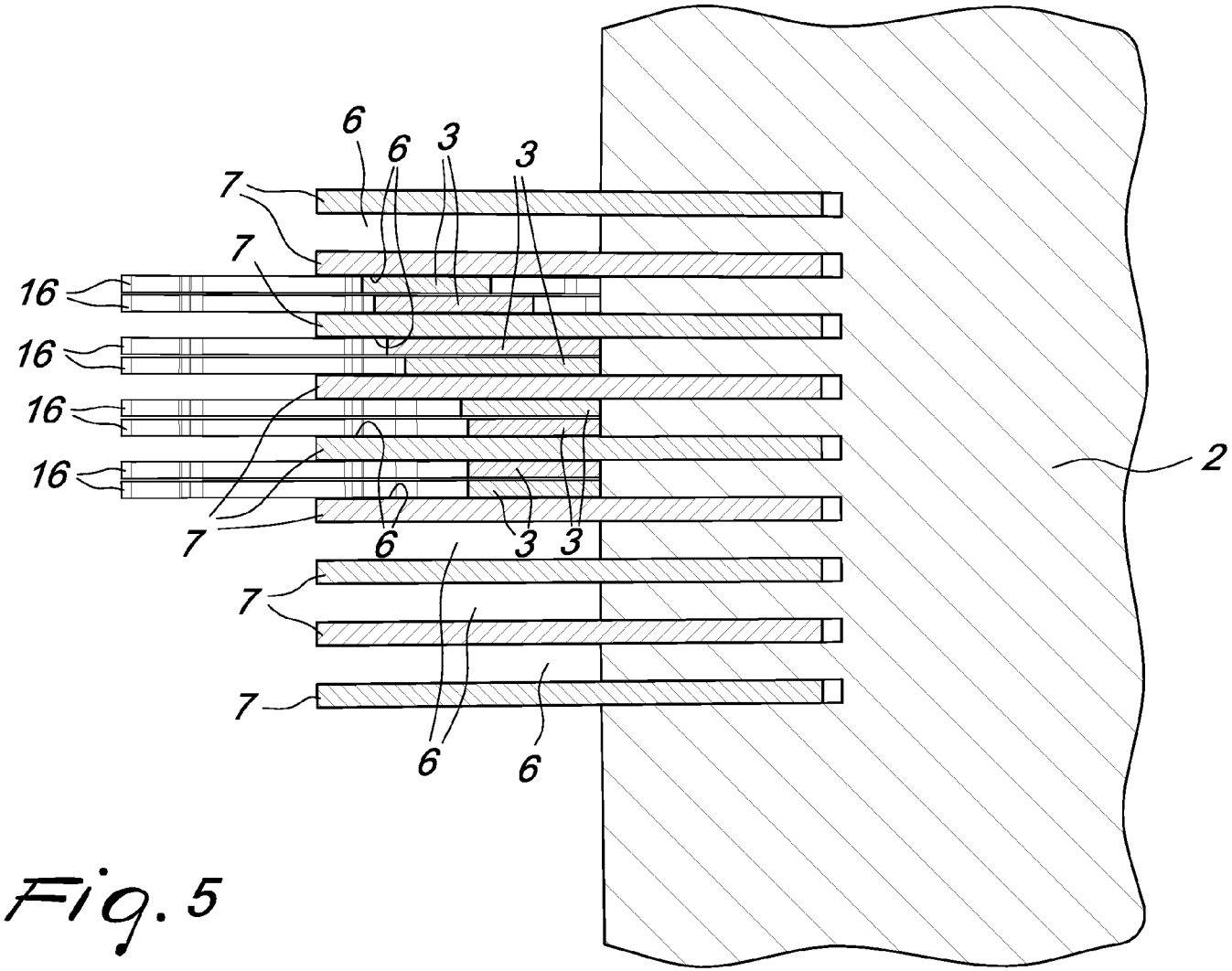
Figure 6:
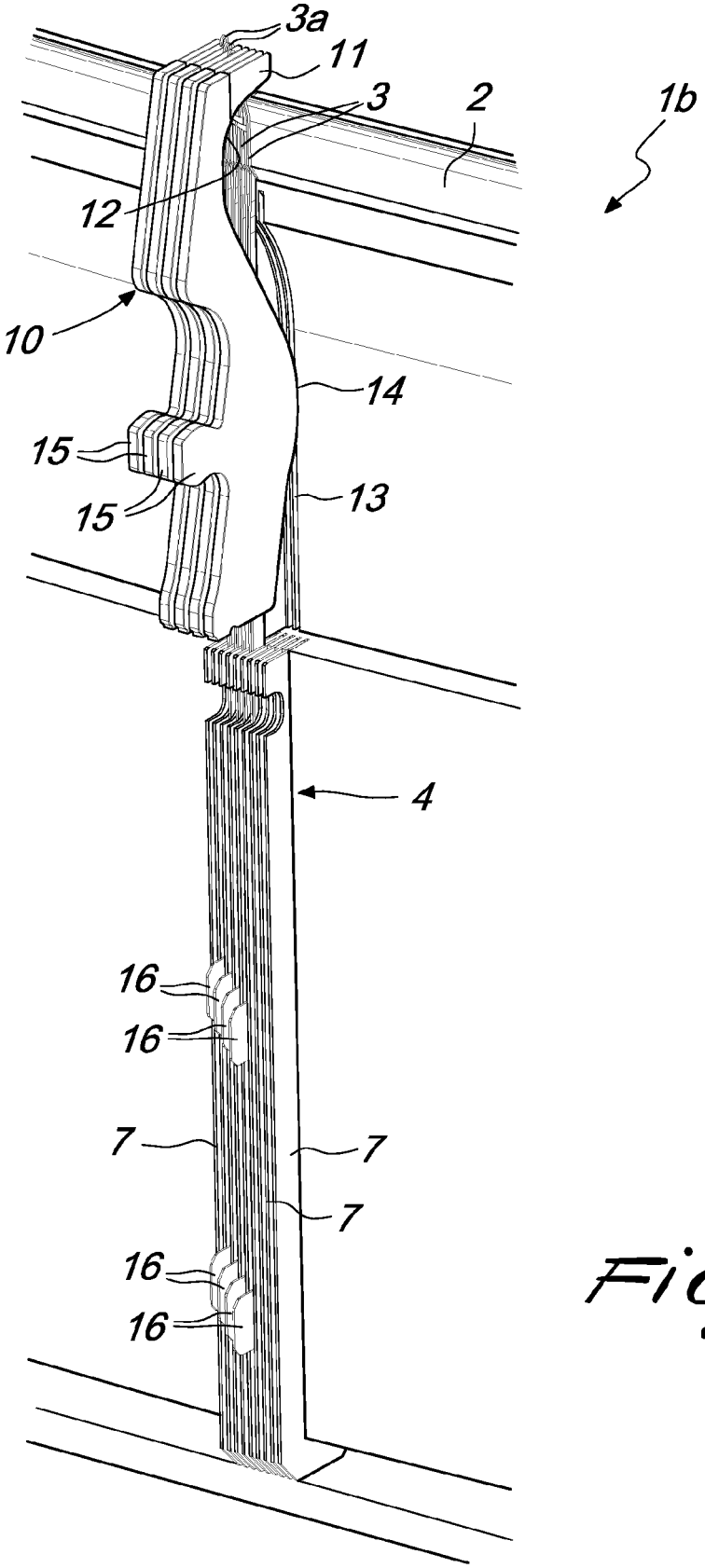
FIGS. 6 to 10 are views of a second embodiment of the machine according to the invention, constituted by a single-cylinder circular knitting machine without sinkers, more particularly.

With reference to the figures, the machine according to the invention, generally designated by the reference numerals 1*a*, 1*b*, in both of the illustrated embodiments comprises a needle holder 2, which supports a plurality of needles 3 that can be actuated with an alternating motion along their axis with respect to the needle holder 2, and means 4 for guiding the needles 3 in their motion with respect to the needle holder 2.

Each needle 3 can be actuated with an alternating motion along its own axis with respect to the needle holder 2 with an extraction motion, by means of which the needle 3 is extracted, with its tip 3*a* and with a portion of its shank, from one end of the needle holder 2 in order to drop, onto its shank, the loop of knitting formed previously and/or in order to pick up the yarn or yarns dispensed at a feed or drop of the machine, and with a retracting motion, by means of which the needle 3 is made to retract with its tip 3*a* in said end of the needle holder 2 in order to form a new loop of knitting, performing the knockover of the loop of knitting formed previously in order to produce knitting.

In both of the illustrated embodiments, which refer to circular knitting machines, the needle holder 2 is constituted by a needle cylinder, which has a vertical axis, and each needle 3 can be actuated with an alternating motion along its own axis, which is oriented parallel to the axis of the needle cylinder 2, with an extraction motion in order to protrude with its tip 3*a* and with part of its shank from the upper end of the needle cylinder 2 and with a retracting motion in order to retract into said end of the needle cylinder 2.

The guiding means 4 of the needles 3 comprise channels for forming knitting 5 which are defined proximate to the upper end of the needle cylinder 2 and sliding channels defined on the lateral surface of the needle cylinder 2 in a region that is spaced from the upper end of the needle cylinder 2. Each one of the knitting forming channels 5 can be engaged by a needle 3 and defines with its inlet, which is directed toward the outside of the needle cylinder 2, resting contact regions for the knitting during the retracting motion of the needles 3.

According to the invention, the number of sliding channels 6 is smaller than the number of knitting forming channels 5.

Preferably, each sliding channel 6 accommodates at least two needles 3 which are arranged mutually side by side. As a consequence of this fact, at least some of the needles 3 accommodated in a same sliding channel 6 are axially offset with respect to the corresponding knitting forming channel 5 in which they must slide in order to exit from the needle cylinder 2 and retract subsequently. Despite this, each needle 3 can slide correctly in the corresponding knitting forming channel 5 by utilizing the elastic flexibility, in a lateral direction, of the shank of the needle 3. Elastic flexibility is particularly high in needles 3 for high-gauge machines as a consequence of the low thickness of the needles 3.

The sliding channels 6 are arranged mutually side by side transversely to the axis of the needles 3 that they accommodate and are mutually separated by slats 7 which are integral with the body of the needle holder 2.

The machine according to the invention has, for an equal number of needles 3, a smaller number of slats 7 than the number present in conventional knitting machines. Thanks to this fact, the slats 7 can be thicker or this smaller number of slats 7 can be utilized to reach gauges that until now were unattainable in knitting machines.

The sliding channels 6 can be obtained from the solid on the lateral surface of the needle cylinder 2, i.e., can be constituted by axial grooves defined on the lateral surface of the needle cylinder 2. In this case, the slats 7 are part of the body of the needle cylinder 2, being constituted by the regions of the needle cylinder 2 that are located between the axial grooves that constitute the sliding channels 6.

Preferably, the sliding channels 6, which are arranged mutually side by side transversely to the axis of the needles 3 that they accommodate, are delimited laterally by laminas which are driven into adapted cuts provided in the lateral surface of the needle cylinder and constitute the slats 7, as shown.

The channels for forming knitting 5 also can be obtained from the solid, i.e., constituted by grooves provided in the lateral surface of the needle cylinder 2 proximate to its upper end, as shown in the second embodiment, or can be delimited laterally by laminas or secondary sinkers which are driven into the body of the needle cylinder 2 proximate to its upper end, or again can be delimited laterally by sinkers 8 which are supported, in a per se known manner, by a sinker ring 9, which is fixed coaxially to the needle cylinder 2 at its upper end, as shown in the first embodiment.

Figure 7:
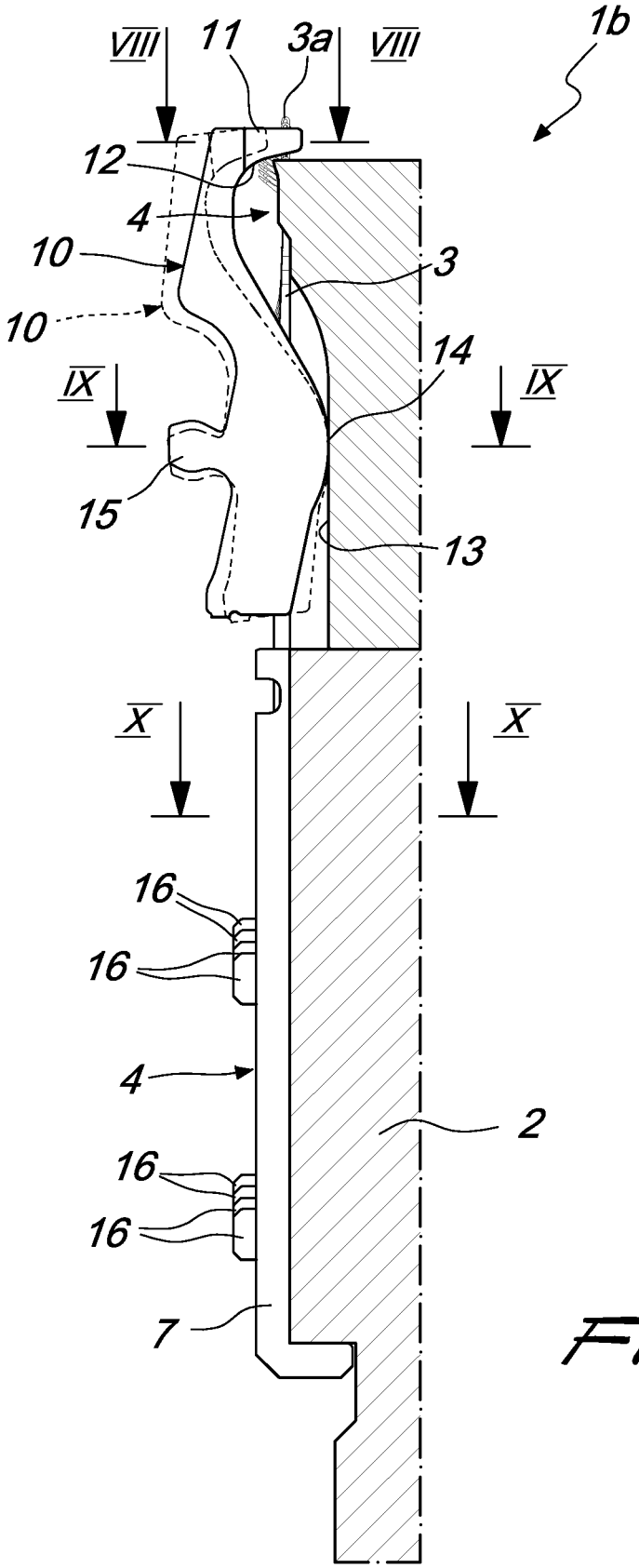
Figure 8:
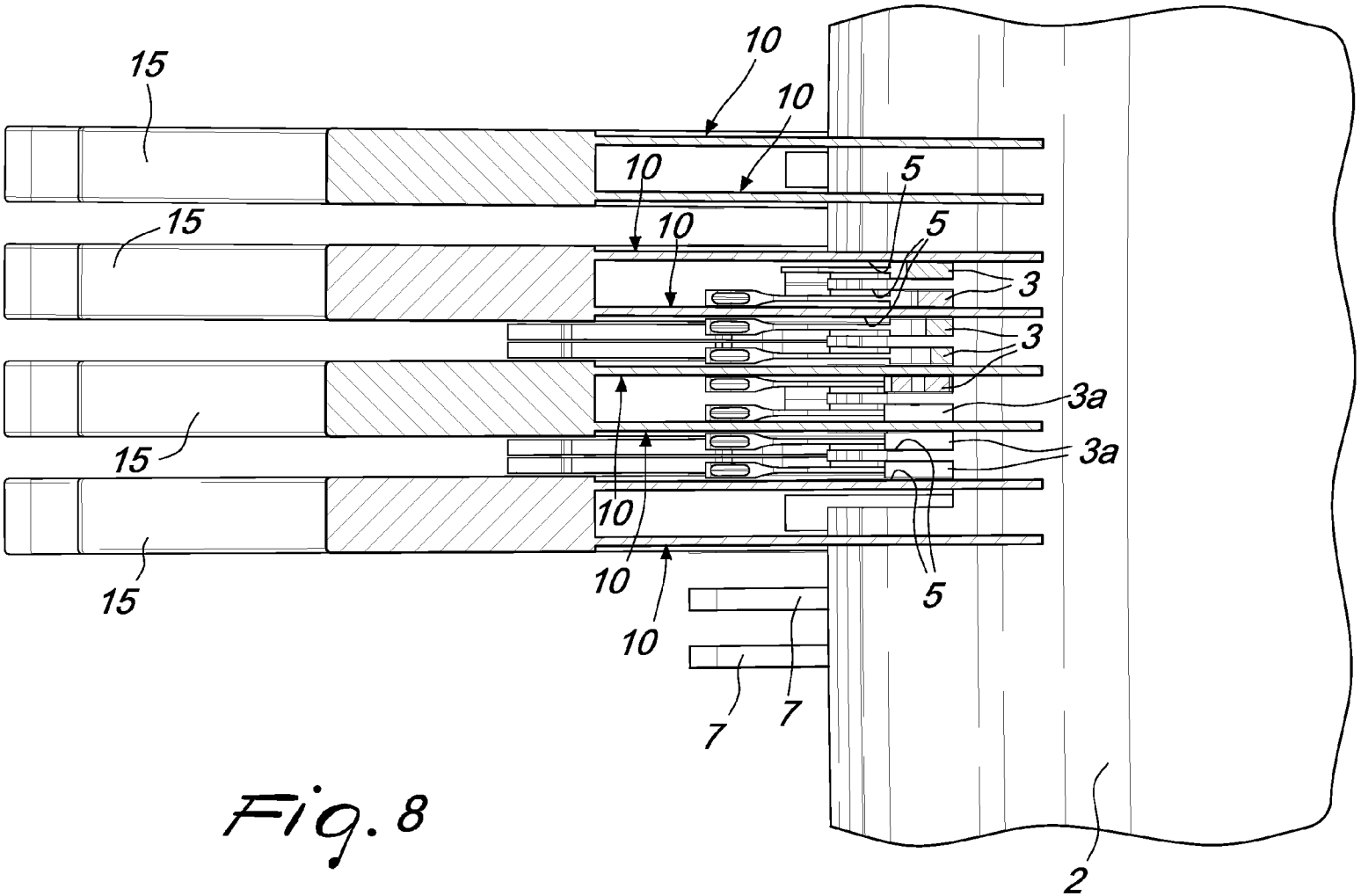
Figure 9:
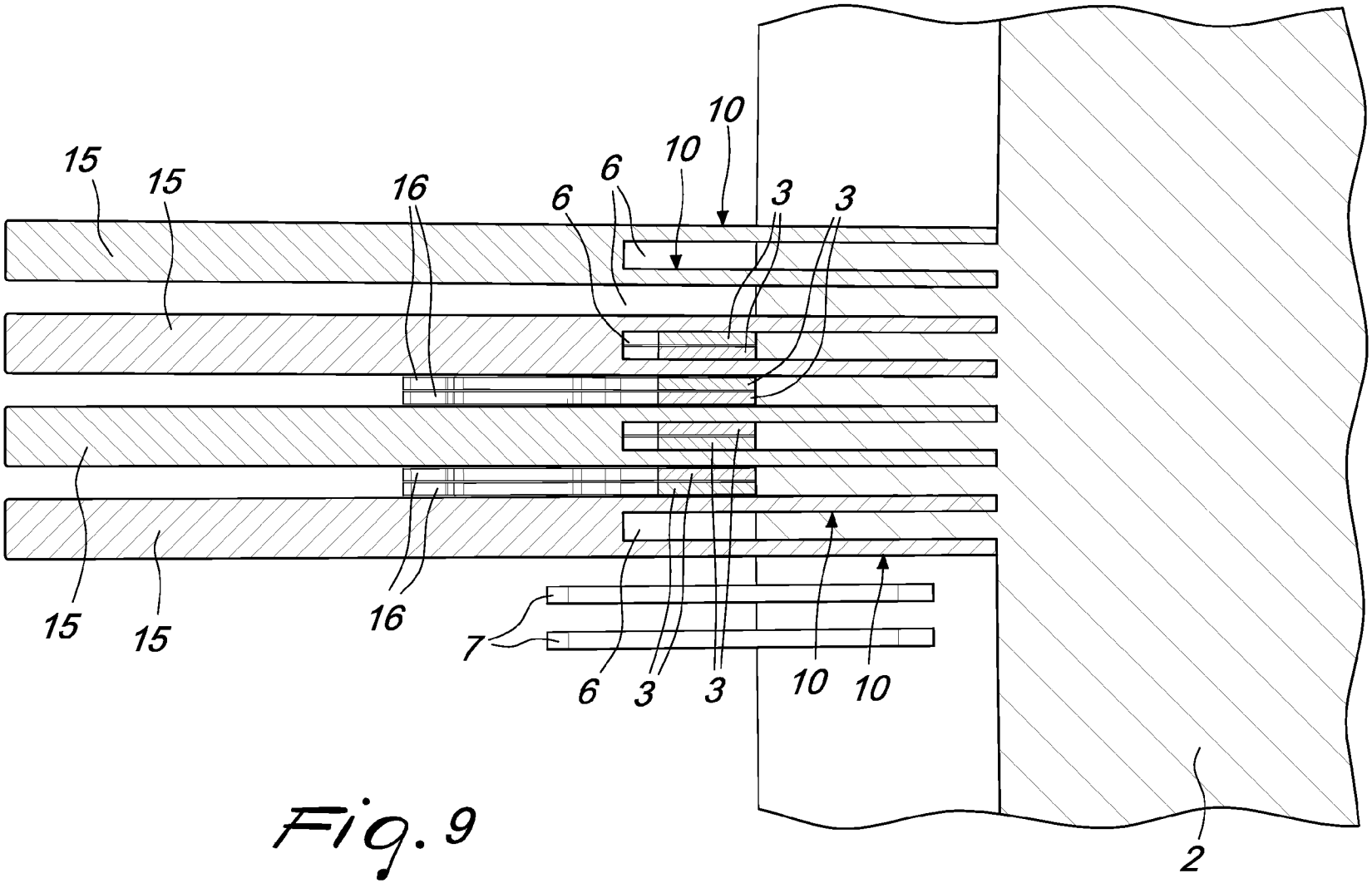
Figure 10:
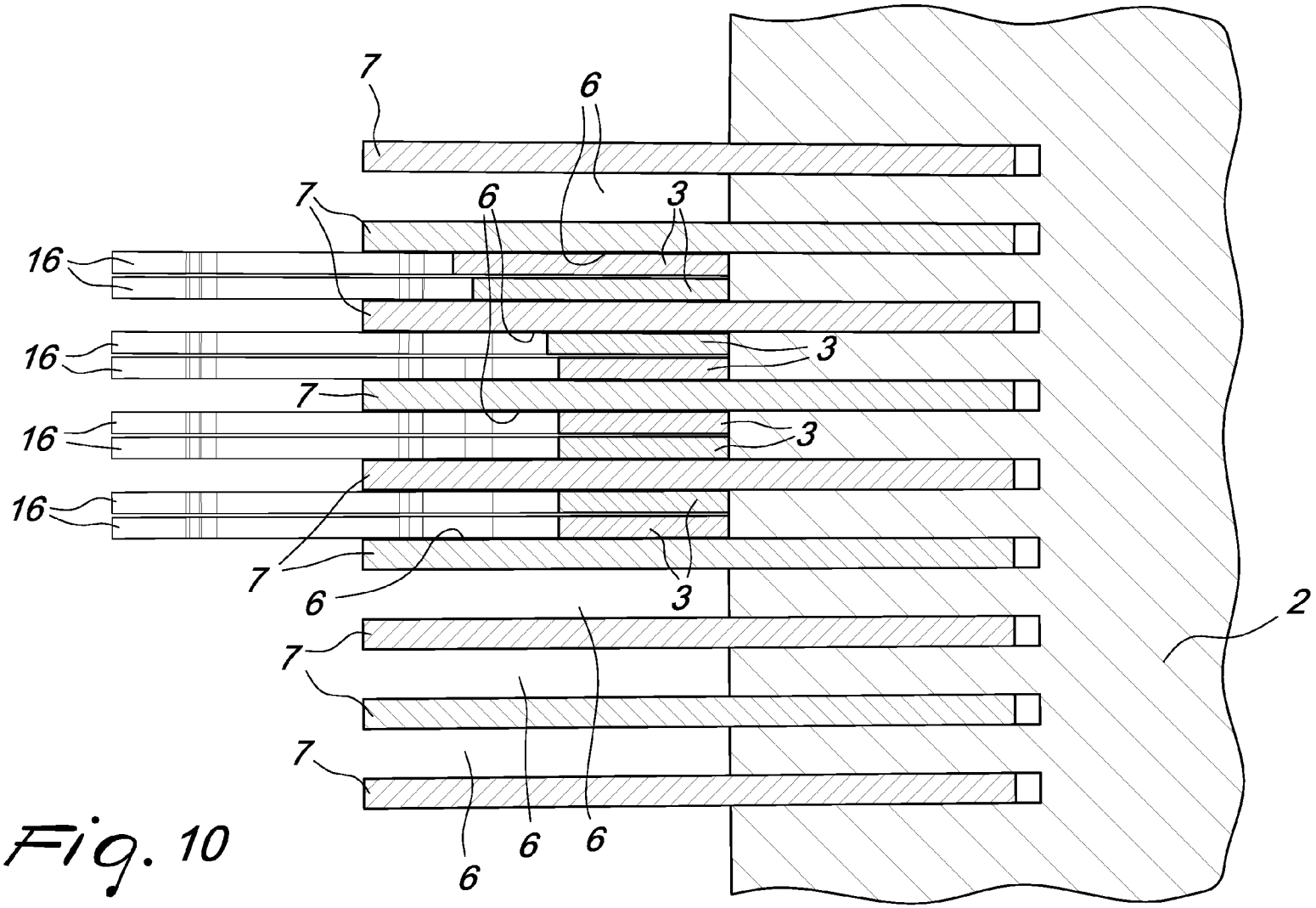

In the second embodiment, which relates to a circular knitting machine without sinkers 8, elements for retaining the knitting 10 are provided, which have a portion 11 that defines a stop shoulder 12 for the knitting. Each knitting retention element 10 can move on command from a first position, which is shown in dashed lines in FIG. 7 and in which it does not interfere with the knitting being formed, to a second position, shown in solid lines in FIG. 7, in which it enters, with its portion 11, between two contiguous needles 3, so as to contrast the traction of the knitting along the needles 3 during the extraction motion thereof, as disclosed in WO2008/003463 and WO2008/145433.

Each knitting retention element 10 is arranged on the lateral surface of the needle cylinder 2 in which the sliding channels 6 are defined and lies on a plane that is substantially perpendicular to the lateral surface of the needle cylinder 2, i.e., on a plane that passes through the axis of the needle cylinder 2. Each knitting retention element 10 has a longitudinal end that defines the portion 11 and protrudes beyond the upper end of the needle cylinder 2. This longitudinal end of the knitting retention element 10 is extended in the direction of the needle cylinder 2 in order to define, with its side directed toward the upper end of the needle cylinder 2, the stop shoulder 12.

Preferably, the knitting retention elements 10 are arranged in a region of the needle cylinder 2 that is not occupied by the slats 7 and delimit the sliding channels 6 instead of the slats 7.

The knitting retention elements 10 have a laminar body that is conveniently inserted in a corresponding groove 13 which is arranged in alignment with a corresponding slat 7, which is interrupted at said groove 13. Each knitting retention element 10 rests on the bottom of the corresponding groove 13 by means of a cradle-shaped portion 14 thereof and can oscillate on its plane of arrangement, i.e., on a plane that passes through the axis of the needle cylinder 2 in the illustrated embodiment, in order to pass from the first position to the second position described above and vice versa.

The passage of the knitting retention elements 10 from the first position to the second position and vice versa, in a manner which is coordinated with the actuation of the needles 3, is achieved by way of adapted actuation means. These actuation means comprise, for each knitting retention element 10, a heel 15 which is provided in an intermediate region of the extension of the corresponding knitting retention element 10 and can engage cams, not shown for the sake of simplicity, which are arranged, like the needle actuation cams, around the needle cylinder 2 and define paths that can be engaged by the heels 15 as a consequence of the actuation of the needle cylinder 2 with a rotary motion about its own axis with respect to said cams.

Preferably, each knitting retention element 10 is connected integrally, proximate to its side directed away from the needle cylinder 2, to at least one contiguous knitting retention element 10, so as to increase the resistance to deformation of the knitting retention elements 10.

In the machine according to the invention, the thickness of the slat 7 is expressed by the following formula:

$$\text{Slat thickness}=[(25.4/E)/R]-(S/R+G)$$

where:

E=gauge (needles/inch)

S=needle thickness (mm)

G=needle play (mm)

R=ratio (sliding channels/knitting forming channels)

As can be seen, for an equal gauge E, needle thickness S and needle play G, with respect to conventional machines, the machine according to the invention can have a higher slat thickness S, i.e., having set a minimum slat thickness S in order to have satisfactory strength, the machine according to the invention can have a higher gauge E than conventional machines.

For the sake of completeness in description, it should be noted that the needles 3 are provided, in a per se known manner, with heels 16 that protrude from the needle cylinder 2 and can engage paths defined by needle actuation cams 3, of a known type and not shown for the sake of simplicity, which face the lateral surface of the needle cylinder 2, which can be actuated with a rotary motion about its own axis with respect to said actuation cams.

Operation of the machine according to the invention, as regards the way of actuation of the knitting forming elements, is similar to that of conventional machines, with the difference that inside each sliding channel 6 a plurality of needles 3 is provided instead of a single needle 3.

The needles 3 that are present in the same sliding channel 6, in the case of two needles 3, have one side in contact with a slat 7 and one side in contact with the other needle 3. If there is, inside a same sliding channel 6, a group of needles composed of a larger number of needles 3, this condition occurs for the needles 3 that are located at the lateral ends of the group, while the intermediate needles 3 have both sides in contact with another needle of the same group.

The relative movement between two neighboring needles 3 arranged in the same sliding channel 6 depends on the inclination of the profile of the actuation cams of the needles 3 with which the heels 16 of said needles 3 engage. The relative speed between the two needles 3 is different from zero when the variation of the pressure angle of these cams is different from zero and is nil when the pressure angle remains constant. The expression "pressure angle" is used to reference the angle of inclination of the cams that actuate the needles 3 with respect to the direction of motion of the needle cylinder 2 or more generally of the needle holder with respect to the actuation cams.

As a consequence of this fact, while creeping occurs between a needle 3 and a contiguous slat 7 every time the needle 3 is moved with respect to the needle cylinder 2 or more generally with respect to the needle holder, creeping occurs between two contiguous needles 3 arranged inside a same sliding channel 6 only when there is a variation of the pressure angle of the cams for the actuation of the needles 3. For this reason, in the machine according to the invention the work performed by the friction force on one of the two sides of the needle 3 is lower and therefore there is a lower consumption of energy and a lower heating than in conventional machines.

Although the invention has been conceived in particular to provide knitting machines with a higher gauge than currently commercially available knitting machines, it can be used advantageously also in machines having a lower gauge, so long as the needles have sufficient lateral flexibility to compensate for the axial offset with respect to the channel for forming the knitting in which they must slide. Even in machines having a lower gauge, by arranging a plurality of needles within a same sliding channel, advantages are achieved in terms of lower production costs, lower energy consumption and lower heating with respect to conventional machines.

Depending on the requirements, in the machine according to the invention it is also possible to have needles with a plurality of heels in order to provide several knitting patterns or contiguous needles, arranged in a same sliding channel, which are provided with heels arranged at the same height level, with the advantage of having better resting contact of the two heels against the needle actuation cams and of avoiding torsions of said heels during the rise and descent along the needle actuation cams.

Moreover, thanks to the fact that the forces produced by the engagement of the needles with the needle actuation cams are discharged on the slat, which can have an adequate thickness even with high gauges, greater rigidity for the set of elements of the machine that must form knitting is achieved and higher operating reliability is obtained.

In practice it has been found that the machine according to the invention fully achieves the intended aim, since it can have a gauge that cannot be achieved with conventional machines or, for an equal gauge with currently commercially available machines, it has a distinctly greater strength and reliability as regards the elements of the machine assigned to forming knitting.

Although the invention has been described with reference to the two illustrated embodiments, which refer to a single-cylinder circular machine with sinkers and to a single-cylinder circular machine without sinkers, it can also be applied to other types of knitting machines, such as for example double-bed machines with cylinder and dial, without thereby abandoning the scope of the protection of the present invention. In application to other types of machine, the needle holder can assume other shapes with respect to the cylindrical shape, for example with a bed that is planar with the sliding channels and consequently the knitting forming channels, arranged on a same plane and side by side parallel to each other, or like a disk in which the sliding channels, and consequently the knitting forming channels, are arranged radially around the axis of the disk, as in the case of the dial of circular machines with cylinder and dial, as is evident for a person skilled in the art.

The machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2010A001974 from which this application claims priority are incorporated herein by reference.

The invention claimed is:

1. A knitting machine comprising:

a needle holder;

a plurality of needles each extending along a longitude axis and actuatable with an alternating motion along the axis; and means for guiding said needles on said needle holder, wherein each needle is actuatable with an alternating motion along the axis of each needle with respect to said needle holder with an extraction motion, which extraction motion allows the needle to be extracted with a tip and a portion of a shank of the needle from an end of the needle holder to drop, onto the shank, the previously formed loop of knitting and/or to pick up the yarn or yarns dispensed at a feed or drop of the machine, and wherein each needle is actuatable with an alternating motion along the axis with respect to said needle holder with a retracting motion, which retracting motion allows the needle to be made to retract with the tip into said end of the needle holder to form a new loop of knitting, thereby performing knockover of the loop of knitting formed previously to produce knitting, said guiding means comprising:

channels for forming knitting located on said needle holder proximate to said end of the needle holder; and sliding channels defined on said needle holder in a region that is spaced from said end of the needle holder, wherein each channel for forming knitting is engageable by a needle and has an inlet directed toward the outside of said needle holder, wherein the channel defines through the inlet resting contact regions for the knitting during the retracting motion of the needles, wherein the number of said sliding channels is smaller than the number of said channels for forming knitting.

2. The machine according to claim 1, wherein each one of said sliding channels accommodates at least two needles arranged side by side, at least one of said two needles, in the absence of forces that act thereon, lying in a direction which is axially offset with respect to a corresponding channel for forming knitting and being able to slide within said corresponding channel for forming knitting by elastic flexibility of the needle in a lateral direction.

3. The machine according to claim 2, wherein said sliding channels are arranged mutually side by side and are mutually separated by slats which are jointly connected to the body of the needle holder.

4. The machine according to claim 1, wherein said channels for forming knitting are constituted by grooves formed in the body of said needle holder proximate to said end of the needle holder.

5. The machine according to claim 1, wherein said channels for forming knitting are delimited laterally by laminas which are embedded in the body of said needle holder proximate to said end of the needle holder.

6. The machine according to claim 1, wherein said channels for forming knitting are delimited laterally by sinkers which are supported by a sinker holder, which is connected to said needle holder at said end of the needle holder.

7. The machine according to claim 3, further comprising knitting retention elements which have a portion that defines a stop shoulder for the knitting, each knitting retention element being movable on command from a first position, in which it does not interfere with the knitting being formed, to a second position, in which it is inserted, with said portion, between two contiguous needles, in a region that faces said end of the needle holder, in order to retain the portion of knitting that is extended between two contiguous needles, contrasting the traction of the knitting along the needles during their extraction motion, means being provided for the actuation of said knitting retention element for its transition from said first position to said second position and vice versa in coordination with the actuation of the contiguous needles.

8. The machine according to claim 7, wherein said knitting retention elements are arranged in a region of said needle holder, in which region said slats are not presented.

9. The machine according to claim 7, wherein said knitting retention elements have a laminar body which is inserted in a groove arranged in alignment with a corresponding slat of said slats.

10. The machine according to claim 7, wherein each one of said knitting retention elements can oscillate on its plane of arrangement in order to move from said first position to said second position and vice versa, actuation means being provided which act on said knitting retention elements for their oscillation on the corresponding plane of arrangement.

11. The machine according to claim 9, wherein each one of said knitting retention elements has its side directed toward the bottom of the groove, in which it is inserted, which is cradle-shaped.

12. The machine according to claim 7, wherein each knitting retention element is jointly connected, proximate to its side directed away from the needle holder, to at least one contiguous knitting retention element.

13. The machine according to claim 7, wherein each knitting retention element is arranged on the face of said needle holder in which said sliding channels are defined and lies on a plane that is substantially perpendicular to said face, said knitting retention element having a longitudinal end which defines said portion and protrudes beyond said end of the needle holder; said longitudinal end of the knitting retention element protruding in the direction of the needle holder in order to define, with its side directed toward said end of the needle holder, said stop shoulder.

14. The machine according to claim 1, wherein said needle holder is cylindrical, said sliding channels and said channels for forming knitting being arranged along the lateral surface of said cylinder and being oriented parallel to the axis of said cylinder.

15. The machine according to claim 1, wherein said needle holder is disc-shaped, said sliding channels and said channels for forming knitting being extended on one face of said disc and being oriented radially with respect to the axis of said disc.

* * * * *